US005127493A

United States Patent [19]

Yasuda et al.

[11] Patent Number: 5,127,493

[45] Date of Patent: Jul. 7, 1992

[54] LINEAR MOTOR ELEVATOR SYSTEM

[75] Inventors: Kunio Yasuda, Tokorozawa; Toshiaki Nakagawa, Akigawa, both of Japan

[73] Assignee: Kabushiki Kaisha Toshiba, Kawasaki, Japan

[21] Appl. No.: 600,767

[22] Filed: Oct. 23, 1990

[30] Foreign Application Priority Data

Oct. 30, 1989 [JP] Japan ..... 1-282166
Jul. 13, 1990 [JP] Japan ..... 2-185607

[51] Int. Cl.[5] ..... B66B 17/12
[52] U.S. Cl. ..... 187/94; 187/112
[58] Field of Search ..... 187/1 R, 94, 95, 112

[56] References Cited

U.S. PATENT DOCUMENTS 3,845,842 11/1974 Johnson ..... 187/94
5,005,672 4/1991 Nakai et al. ..... 187/112

FOREIGN PATENT DOCUMENTS 0048847 9/1981 European Pat. Off. .
0213848 8/1986 European Pat. Off. .

*Primary Examiner*—H. Grant Skaggs
*Assistant Examiner*—Kenneth Noland
*Attorney, Agent, or Firm*—Foley & Lardner

[57] ABSTRACT

An elevator system driven by a linear motor and elevated up and down in a hoistway including a cage, a counter weight and a hoisting rope having both ends by and from which the cage and the counter weight are suspended so as to be alternatively elevated up and down in the hoistway. A reaction plate is supported by the side wall of the hoistway throughout an entire vertical length of the side wall. A stator is secured to the counter weight at a portion facing the reaction plate with a small gap therebetween and a guide is secured to the counter weight for guiding the elevation thereof. The guide is a guide roller structure comprising a support plate secured to the counter weight by a bolt, an adjusting rod engaged with the support plate on a side opposing to the reaction plate for adjusting a securing position of the support plate and a guide roller abutting against the reaction plate so as to be rollable therealong. The guide roller may be replaced with a guide shoe secured to the counter weight and mounted to the reaction plate to be slidable therealong. The guide may include a combination of a guide shoe and a guide roller.

14 Claims, 4 Drawing Sheets

LINEAR MOTOR ELEVATOR SYSTEM

BACKGROUND OF THE INVENTION

The present invention relates to an elevator system driven by a linear motor in which a cage and a counter weight are alternatingly elevated up and down by means of a hoisting rope in a hoistway of a multistoried building, for example, with excellent elevating performance during the elevating motion of the linear motor elevator system.

A conventional elevator driven by a linear motor, called hereinafter a linear motor elevator or elevator, utilizes a linear motor as a driving means for elevating a cage for persons or articles and a counter weight alternatingly by means of a hoisting rope in a hoistway extending in a multistoried building.

In the linear motor elevator system, a reaction plate is secured in a suspended manner to an inner side wall of the hoistway and a stator is secured to the counter weight facing the reaction plate with space therebetween. The cage and the counter weight are alternatingly elevated up and down in the hoistway by a thrust force caused by passing electric current to the stator.

One example of the conventional linear motor elevator system of the type described above will be explained in detail hereunder with reference to FIGS. 6 to 8.

Referring to FIGS. 6 to 8, a hoistway for elevating the elevator system, including a cage 5 and a counter weight 7, is designated by reference numeral 1, and a frame 2 is horizontally stretched across the upper portion of the hoistway 1 and supported at both ends thereof to the side wall of the hoistway 1. A pair of deflector sheaves 3*a* and 3*b* are mounted to the frame 2 and a hoisting rope 4 is stretched around the sheaves 3*a* and 3*b*. The hoisting rope 4 has one end 4*a* on which is suspended the cage 5. Cage 5 is provided with a guide shoe 5*a*, to be elevated up and down along a guide rail 6 supported by the side wall of the hoistway 1. The hoisting rope 4 has the other end 4*b* by which is suspended the counter weight 7 provided with a guide shoe 7*a* to be elevated up and down along a guide rail 8 supported by the side wall of the hoistway 1 by means of a plurality of supporting members 12 through a plurality of anchor bolts 13 as shown in FIG. 7. A reaction plate 9 is supported in a suspended manner to the side wall of the hoistway 1 throughout substantially the entire vertical length of the side wall of the hoistway 1 by means of a plurality of brackets 10. A stator 11 is mounted to the counter weight 7 at a portion facing the reaction plate 9 with a slight gap C having a distance of several mm as shown in FIG. 7. The location and the adjustment of this gap C has a very significant meaning for the performance of the linear motor elevator system.

As shown in FIG. 7, the guide shoes 7*a* and the guide rails 8 for the counter weight 7 are disposed at vertically along both sides thereof.

The linear motor elevator system of the structure described above is elevated up and down by the thrust force caused by the electric current passing the stator 11. Namely, the cage 5 and the counter weight 7 both suspended by the hoisting rope 4 are elevated up and down alternatingly by this thrust force F shown in FIG. 8.

However, when the cage 5 and the counter weight 7 are elevated alternatingly, an attraction force k is caused between the reaction plate 9 and the stator 11. This attraction force k usually has a magnitude about 2 to 4 times that of the thrust force F. For example, when it is assumed that the usual thrust force F is of about 500 to 3000 kg, the attraction force k of about 1000 to 10,000 kg will be caused. Accordingly, as shown in a magnified manner in FIG. 8, the stator 11 and the reaction plate 9 are mutually attracted and, hence, the guide rails 8 are deformed or bent towards the reaction plate side by a reaction force of the guide shoe 7*a* of the counter weight 7 by a distance within a supporting distance of the supporting members 12. Therefore, it becomes impossible to maintain the prescribed distance of the gap C and in an adverse case, the elevating performance of the elevator system including suitable running speed, electric power consumption, stable arrival condition and the like may be damaged. In addition, the guide rails 8 and the reaction plate 9 are deformed, which may result in the loosening of the anchor bolts 13 of the supporting members 12 with time, to become dangerous. The use of an increased number of the anchor bolts 13 to obviate such defect may result in cost increases.

SUMMARY OF THE INVENTION

An object of the present invention is to substantially eliminate defects or drawbacks encountered in the prior art and to provide an elevator system driven by a linear motor capable of achieving improved elevation performance while maintaining a suitable space or gap between a stator of the elevator and a reaction plate during the elevation of the elevator.

Another object of the present invention is to provide a linear motor elevator system with a guide means for achieving safe elevating operation while maintaining a suitable space or gap between the stator and the reaction plate during the elevation of the elevator.

These and other objects can be achieved according to the present invention by providing an elevator system driven by a linear motor and elevated up and down in a hoistway having inner side walls, comprising a cage, a counter weight, a hoisting rope having both ends by and from which the cage and the counter weight are respectively suspended so as to be alternatingly elevated up and down in the hoistway, and a reaction plate supported by the inner side wall of the hoistway throughout substantially an entire vertical length of the side wall thereof, wherein a stator is secured to either one of the cage and the counter weight at a portion facing the reaction plate with a small gap therebetween and a guide means is secured to the either one of the cage and the counter weight for guiding the elevation thereof in the hoistway.

In the preferred embodiments, the stator is secured to the counter weight and the guide means is a guide roller comprising a support plate secured to the counter weight by a bolt means, an adjusting rod engaged with the support plate on a side opposing to the reaction plate for adjusting a securing position of the support plate and a guide roller abutting against the reaction plate so as to be rollable therealong. The guide roller means may be secured to the stator or to the counter weight at a portion except the stator. The guide roller means may be substituted with a guide shoe secured to the counter weight and mounted to the reaction plate to be slidable therealong. The guide means may comprise a combination of a guide shoe and a guide roller means, the guide shoe being secured to the counter weight and mounted to the reaction plate to be slidable therealong and the guide roller means comprises a support plate secured to the counter weight by a bolt means, an adjusting rod engaged with the support plate on a side opposing to reaction plate for adjusting a securing position of the support plate and a guide roller abutting against said reaction plate so as to be rollable therealong.

According to the present invention of the characters described above, when the stator and the reaction plate are mutually attracted by passing the electric current to the stator, the gap between the stator and the reaction plate can be suitably maintained by the location of the guide means such as guide roller or guide shoe without bending or deforming the guide rail for the elevator equipment such as counter weight. In a modified embodiment in which the guide shoe is mounted to the reaction plate to be slidable, the guide shoe attains the function as the guide rail and accordingly, the guide rail can be eliminated and the relative positional adjustment between the guide rail and the reaction plate need not be considered.

BRIEF DESCRIPTION OF THE DRAWINGS

For a better understanding of the present invention and to show how the same is carried out, reference is made, by way of preferred embodiments to the accompanying drawings, in which.

DESCRIPTION OF THE PREFERRED EMBODIMENTS

Figure 7:
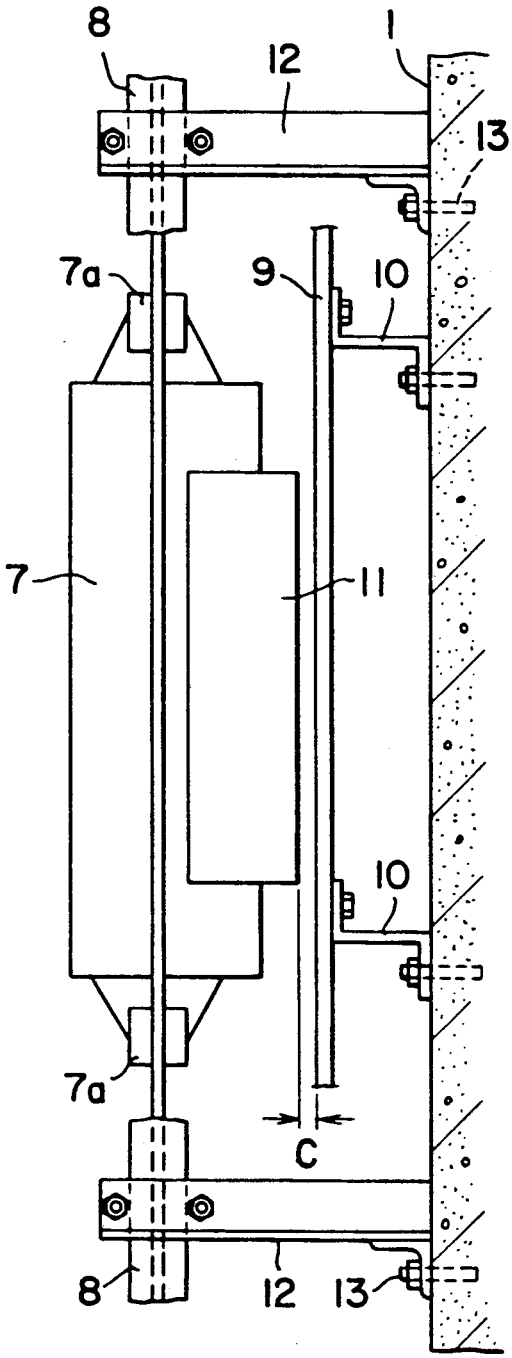
FIG. 7 PRIOR ART
FIG. 7 is a side view in an enlarged scale of a portion of the linear motor elevator system shown in FIG. 6.
Figure 8:
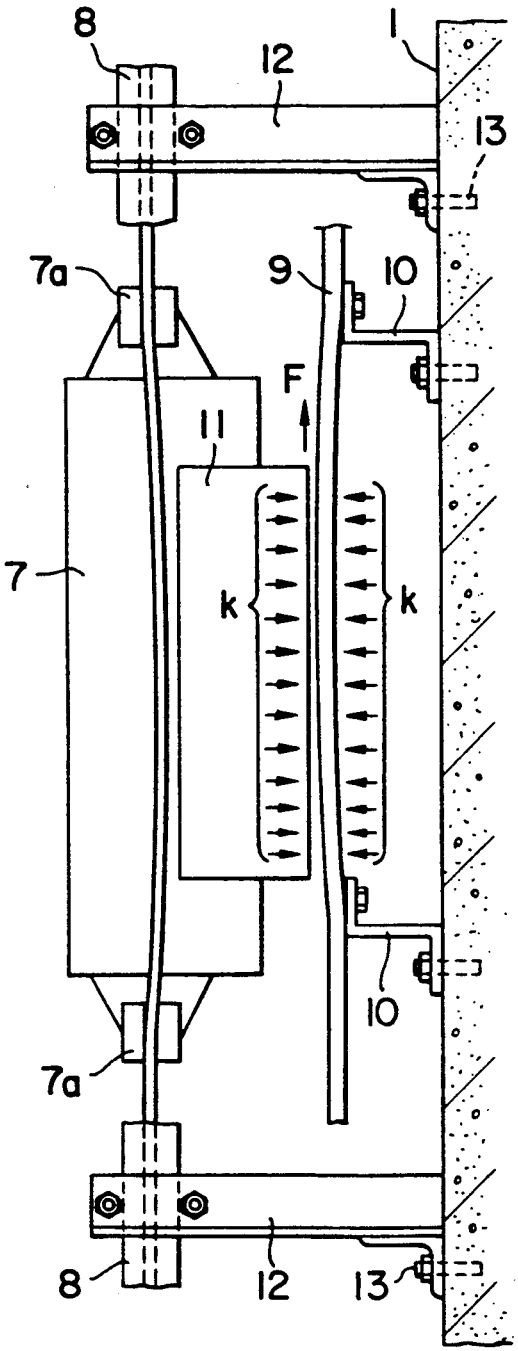
FIG. 8 PRIOR ART
FIG. 8 is a side view similar to that of FIG. 7 for describing the function of the elevator system shown in FIG. 6.

One preferred embodiment according to the present invention will be described hereunder with reference to FIGS. 1 to 3, in which like reference numerals are added to members or elements corresponding to those shown in FIGS. 6 to 8.

Figure 1:
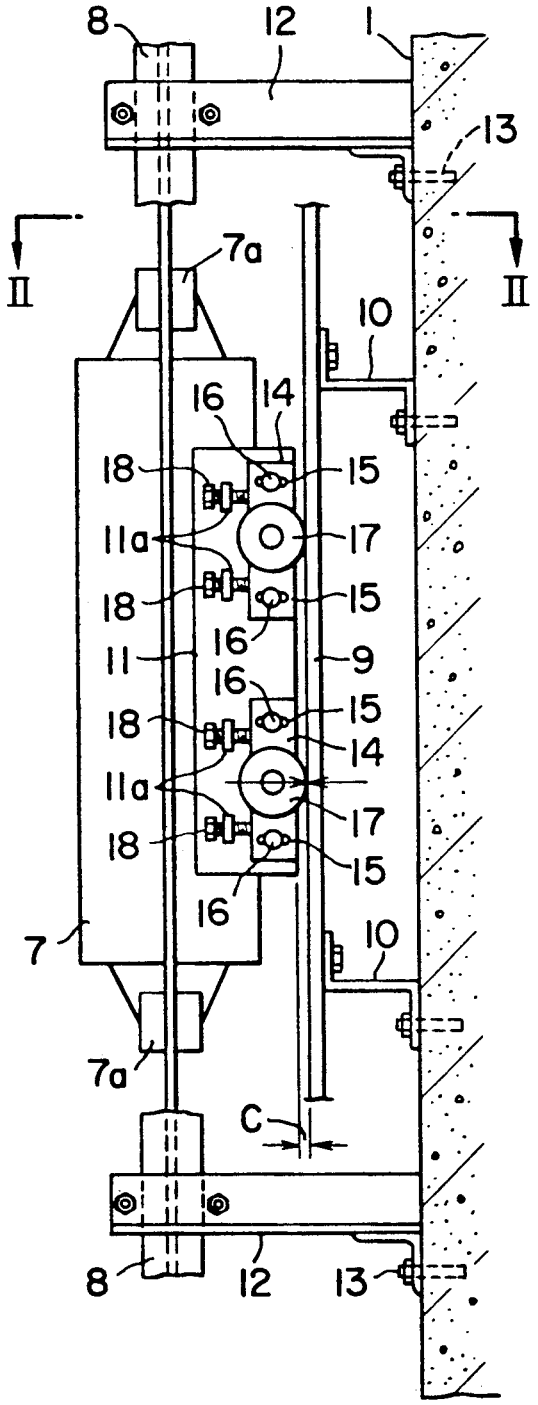
FIG. 1 is a side view of a linear motor elevator system, partially eliminated, according to one embodiment of the present invention.
Figure 2:
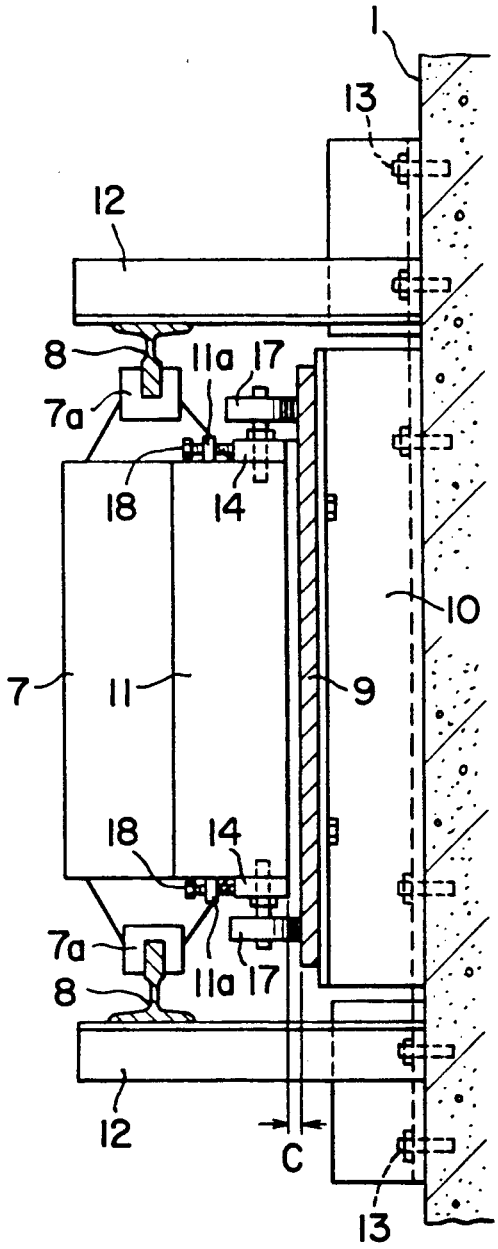
FIG. 2 is a sectional view in an enlarged scale taken along the line II—II shown in FIG. 1.
Figure 6:
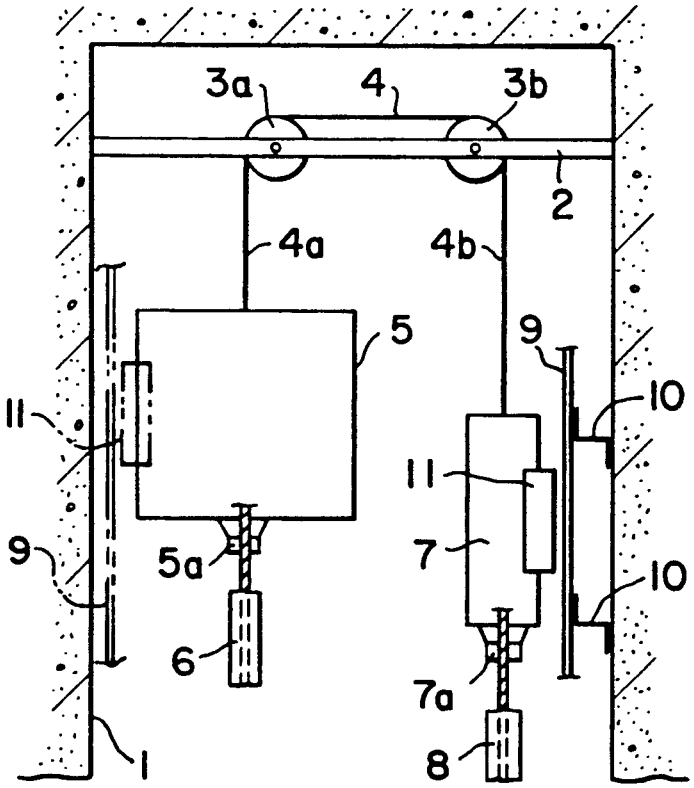
FIG. 6 PRIOR ART
FIG. 6 is a side view of a conventional linear motor elevator system.

FIGS. 1 and 2 show details of the counter weight 7 and the associated members for the linear motor elevator system according to the present invention which is suspended by the hoisting rope 4 shown in FIG. 6. The counter weight 7 will be called hereafter weight 7 for the sake of convenience.

Figure 3:
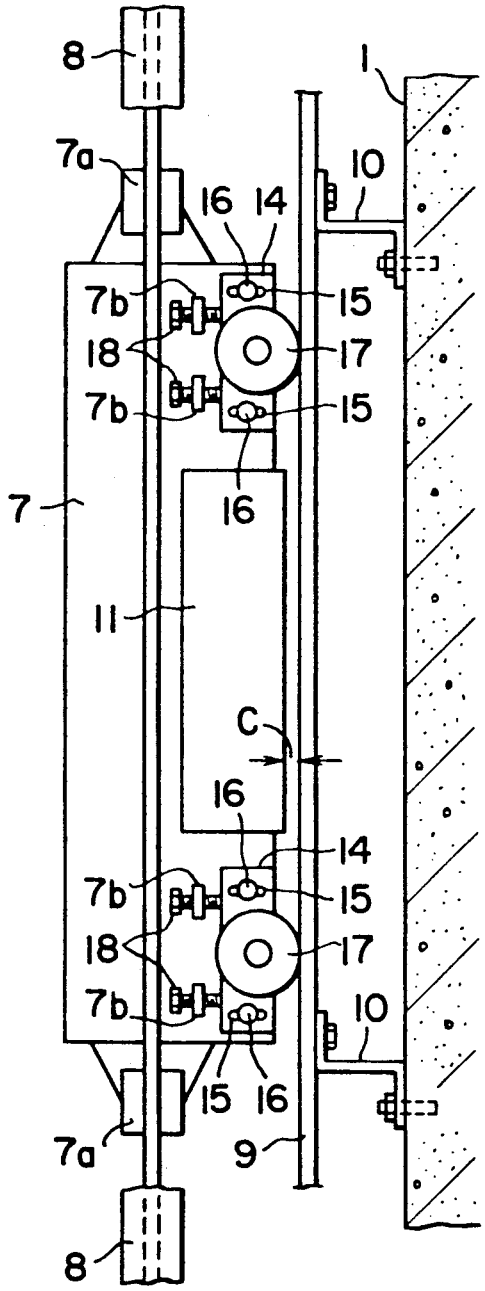
FIG. 3 is a side view similar to that of FIG. 1 according to another embodiment of the present invention.

Although not shown in FIGS. 1 to 3, the weight 7 is suspended in the hoistway 1 by means of the hoisting rope 4 as shown in FIG. 6. Namely, in the hoistway 1 for elevating the elevator system, a frame 2 is horizontally stretched across the upper portion of the hoistway 1 and supported at both ends thereof to the side wall of the hoistway 1. A pair of deflector sheaves 3*a* and 3*b* are mounted to the frame 2 and a hoistway rope 4 is stretched around the sheaves 3*a* and 3*b*. The hoisting rope 4 has one end 4*a* by which is suspended the cage 5 provided with a guide shoe 5*a* to be elevated up and down along a guide rail 6 supported to the side wall of the hoistway 1. The hoisting rope 4 has the other end 4*b* by which is suspended the weight 7 provided with a guide shoe 7*a* to be elevated up and down along a guide rail 8 supported to the side wall of the hoistway 1 by means of a plurality supporting members 12 through a plurality of anchor bolts 13. A reaction plate 9 is supported in a suspended manner to the side wall of the hoistway 1 throughout substantially the entire vertical length of the side wall thereof by means of a plurality of brackets 10. A stator 11 is mounted to the weight 7 at a portion facing the reaction plate 9 with a slight gap C having a distance of several mm as shown in FIGS. 1 and 7. The location and the adjustment of this gap C is very significant in the performance of the linear motor elevator system.

The guide shoes 7*a* and the guide rails 8 for the counter weight 5 are disposed vertically on sides thereof.

Referring to FIGS. 1 and 2, a pair of support plates 14 are attached to each side of the stator 11 and a pair of slits 15 elongated horizontally are formed to each of the support plates 14. The support plate 14 are secured to the stator 11 by bolts 16 inserted into the slits 15 to be horizontally adjustable by shifting the bolts 16 in the elongated direction of the slits 15. Guide rollers 17 are attached to the respective support plates 14 at substantially the central portions thereof so as to abut against the surface of the reaction plate 9 to be rolled therealong. The distance of the gap C between the reaction plate 9 and the stator 11 can be fixed at about 2 to 3 mm by the location of the guide rollers 17.

A pair of lugs 11*a* are secured to the stator on one side not facing the reaction plate 9 and a pair of adjusting rods 18 are screw engaged with the lugs 11*a* so that the fixing position of the support plates 14 can be finely adjusted by the adjusting rods 18.

As described with reference to FIGS. 6 to 8, when the electric current passes the stator 11 to thereby generate the thrust force F to elevate the cage 5 and the weight 7 up or down, an attraction force is created between the stator 11 and the reaction plate 9. However, according to the present embodiment, the guide rollers 17 are disposed between the stator 11 and the reaction plate 9 in an abutting and rollable manner, so that the guide rails 8 are not bent by the reaction of the guide shoes 7*a* of the weight 7 in the direction towards the reaction plate 9 and the gap C therebetween can be suitably maintained in the prescribed range even if the stator 11 and the reaction plate 9 are mutually attracted.

FIG. 3 shows another embodiment of the linear motor elevator system according to the present invention, in which the respective guide rollers 17 of the character described above are attached to the counter weight 7 on both vertical sides, as viewed in FIG. 3, of the stator 11.

Referring to FIG. 3, a pair of support plates 14 are attached to the weight 7 on vertical both sides of the stator 11 and a pair of horizontally elongated slits 15 are formed to each of the support plates 14. The support plates 14 are secured to the stator 11 by bolts 16 inserted into the slits 15 to be horizontally adjustable by shifting the bolts 16 in the elongated direction of the slits 15. Guide rollers 17 are attached to the respective support plates 14 at substantially the central portions thereof so as to abut against the surface of the reaction plate 9 to be rolled therealong. The distance of the gap C between the reaction plate 9 and the stator 11 can be set to about 2 to 3 mm by the location of the guide rollers 17.

A pair of lugs 7b are secured to the stator 11 on the side not facing the reaction plate 9 and a pair of adjusting rods 18 are engaged with the lugs 7b, respectively so that the fixing position of the support plates 14 can be finely adjusted by the adjusting rods 18.

In the foregoing embodiments, the gap C is a very significant factor for the elevating performance of the elevator system and accordingly, the adjustment of the gap C by means of the adjusting rods 18 for the guide rollers 17 should be finely performed during the elevating movements of the cage 5 and the weight 7 along the entire vertical length along the inner wall of the hoistway 1.

Also in the foregoing embodiments, the guide rollers 17 may be replaced by guide shoes secured to the counter weight on both sides thereof and mounted to the reaction plate to be rollable therealong such as described hereunder with reference to the following embodiment.

Figure 4:
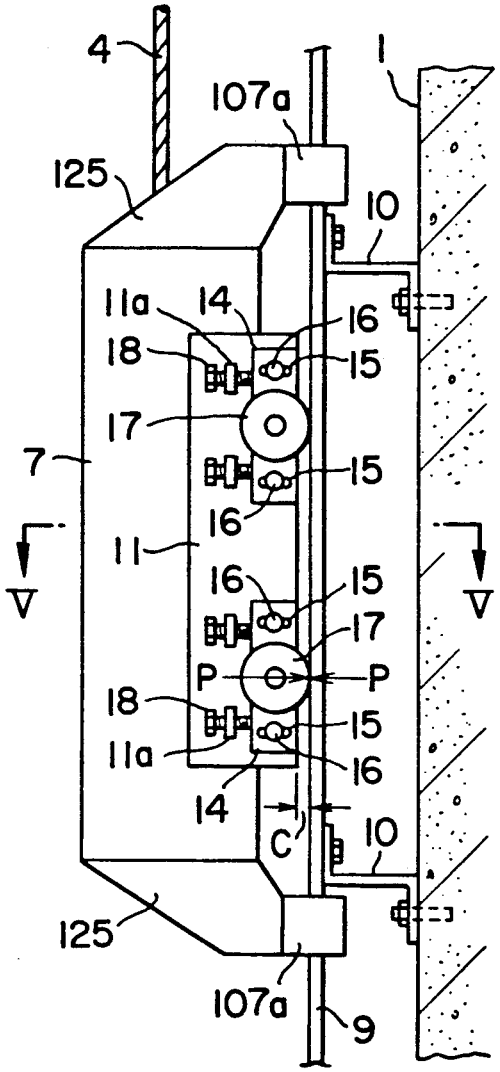
FIG. 4 is also a side view similar to that of FIG. 1 or 3 according to a further embodiment of the present invention.
Figure 5:
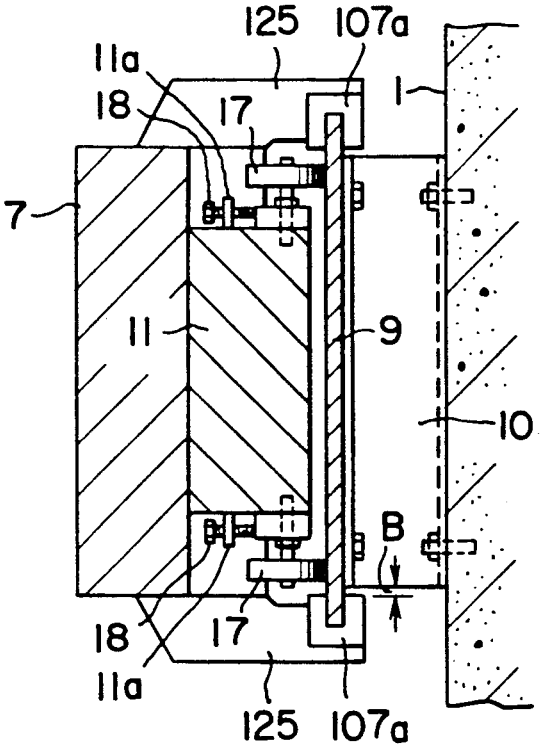
FIG. 5 is a sectional view in an enlarged scale taken along the line V—V shown in FIG. 4.

FIGS. 4 and 5 represent a further embodiment of an elevator system driven by a linear motor according to the present invention conceived in consideration of the above technical matter, in which like reference numerals are added to members and elements corresponding to those shown in FIG. 1.

Referring to FIGS. 4 and 5, pairs of (in total, four), support members 125 are secured to both sides (upper and lower sides, as viewed) of the weight 7, and guide shoes 107a are secured to the front ends of the respective support members 125. The guide shoes 107a are mounted on the reaction plate 9 to be slidable therealong together with the weight 7. As shown in FIG. 5, it is desired to mount the guide shoes 107a to the reaction plate 9 at portions apart from the brackets 10 by distance B about 10 mm so as not to contact to the same.

In this embodiment, the reaction plate 9 attains a function as a guide rail as well as the function of the reaction plate. Accordingly, it is not necessary to locate the guide rails 8 in the hoistway 1 as described with reference to the foregoing embodiments and therefore, the installation of the reaction plate 9 can be performed without paying any attention to the relative positional relationship with respect to the guide rails 8, thus the installation of the reaction plate 9 can be easily carried out.

Moreover, in this embodiment, the attraction force between the stator 11 and the reaction plate 9 is generated as a reaction force P at the contact point between the reaction plate 9 and the guide roller 17. Accordingly, the reaction force P is not generated between the reaction plate 9 and the guide shoes 107a. The motion of the weight 7 in a direction normal to the elevating direction of the weight 7 can be prescribed by the sliding movement of the guide shoes 107a on the reaction plate 9 and therefore, the weight 7 can be smoothly elevated along the reaction plate 9 without trouble, thus achieving excellent performance.

Furthermore, the elimination of the guide rails 8 in the foregoing embodiment reduces materials and cost involved, which are significant for recent multistoried buildings.

Although this embodiment is described with respect to the stator 11 to which the guide rollers 17 are mounted, the embodiment can be also applied to the guide rollers 17 which are mounted to the counter weight body such as shown in FIG. 3.

In the foregoing embodiments, although the guide rollers 17 are attached to the weight 7, the guide rollers 17 may be provided for the cage 5 in the similar manner within the scope of the present invention. The shape and the location of the guide shoes 107a may be changed without being limited to the described embodiment.

What is claimed is:

1. An elevator system driven by a linear motor and elevated up and down in a hoistway having inner side walls, comprising:

a cage;

a counter weight;

hoisting means having two ends by and from which said cage and said counter weight are respectively suspended so as to be alternatingly elevated up and down in said hoistway;

reaction plate means supported by the inner side walls of said hoistway throughout substantially an entire vertical length of the side wall;

stator means secured to either one of said cage or said counter weight at a portion facing said reaction plate means, with a small gap therebetween; and guide means secured to either one of said cage or counter weight for guiding the elevation thereof in the hoistway and maintaining said gap.

2. The linear motor elevator system according to claim 1, wherein said guide means is a guide roller means comprising a support plate secured to either one of said cage or said counter weight by a bolt means, an adjusting rod engaged with said support plate on a side opposing to said reaction plate for adjusting a securing position of said support plate and a guide roller abutting against said reaction plate so as to be rollable therealong.

3. The linear motor elevator system according to claim 1, wherein said stator means is secured to said counter weight.

4. The linear motor elevator system according to claim 3, wherein said guide means is a guide roller means comprising a support plate secured to said counter weight by a bolt means, an adjusting rod engaged with said support plate on a side opposing to said reaction plate for adjusting a securing position of said support plate and a guide roller abutting against said reaction plate so as to be rollable therealong.

5. The linear motor elevator system according to claim 4, wherein said bolt means is inserted into a horizontally elongated hole formed in said support plate so that the securing position of said support plate is horizontally adjustable.

6. The linear motor elevator system according to claim 4, wherein said guide roller means is secured to said stator.

7. The linear motor elevator system according to claim 4, wherein said guide roller means is secured to the counter weight at a portion except said stator.

8. The linear motor elevator system according to claim 1, wherein said guide means is a guide shoe secured to either one of said cage or said counter weight and mounted to said reaction plate to be slidable therealong.

9. The linear motor elevator system according to claim 1 wherein said guide means comprises a combination of a guide shoe and a guide roller means, said guide shoe being secured to either one of said cage or said counter weight and mounted to said reaction plate to be slidable therealong, said guide roller means comprising a support plate secured to either one of said cage or said counter weight by a bolt means, an adjusting rod engaged with said support plate on a side opposing to said reaction plate for adjusting a securing position of said support plate and a guide roller abutting against said reaction plate so as to be rollable therealong.

10. The linear motor elevator system according to claim 9, wherein said stator means is secured to said counter weight.

11. The linear motor elevator system according to claim 9, wherein said guide roller means comprising a support plate secured to said counter weight by a bolt means, an adjusting rod engaged with said support plate on a side opposing to said reaction plate for adjusting a securing position of said support plate and a guide roller abutting against said reaction plate so as to be rollable therealong.

12. The linear motor elevator system according to claim 9, wherein said bolt means is inserted into a horizontally elongated hole formed in said support plate so that the securing position of said support plate is horizontally adjustable.

13. The linear motor elevator system according to claim 9, wherein said guide roller means is secured to said stator.

14. The linear motor elevator system according to claim 9, wherein said guide roller means is secured to the counter weight at a portion except said stator.

* * * * *